US006351203B1

(12) United States Patent
Mihara et al.

(10) Patent No.: US 6,351,203 B1
(45) Date of Patent: Feb. 26, 2002

(54) WIRE WOUND INDUCTOR

(75) Inventors: Hideyuki Mihara, Shiga-ken; Satoshi Murata, Yokaichi; Tetsuya Morinaga, Fukui, all of (JP)

(73) Assignee: Murata Manufacturing Co., LTD, Kyoto (JP)

( * ) Notice: Subject to any disclaimer, the term of this patent is extended or adjusted under 35 U.S.C. 154(b) by 0 days.

(21) Appl. No.: 09/470,094

(22) Filed: Dec. 21, 1999

(30) Foreign Application Priority Data

Dec. 21, 1998 (JP) ..... 10-362145

(51) Int. Cl.[7] ..... H01F 27/02; H01F 27/30
(52) U.S. Cl. ..... 336/90; 336/198; 336/192
(58) Field of Search ..... 336/192, 198, 336/200, 90; 310/90

(56) References Cited

U.S. PATENT DOCUMENTS 6,151,770 A * 11/2000 Hashimoto et al. ..... 29/605

FOREIGN PATENT DOCUMENTS

JP 09115733 * 5/1997

* cited by examiner

*Primary Examiner*—Anh Mai
(74) *Attorney, Agent, or Firm*—Keating & Bennett, LLP

(57) ABSTRACT

A wire-wound inductor includes a substantially square-flanged core member and a case core member. The substantially square-flanged core member includes an upper substantially square flange and a lower substantially square flange. The substantially square-flanged core member, around which a coil is wound, is inserted into the case core member, and the upper flange of the substantially square-flanged core member is fitted in an opening of the case core member. A planar corner abutment surface is provided at each of the four corners of the inner surface of the substantially square opening, and the corners of the upper flange abut the respective planar corner abutment surfaces.

20 Claims, 7 Drawing Sheets

WIRE WOUND INDUCTOR

BACKGROUND OF THE INVENTION

1. Field of the Invention

The present invention relates to a wire-wound inductor and, more particularly, to a surface-mounting-type, high-frequency wire-wound inductor for use in a choke coil, a transformer, and a coil.

2. Description of the Related Art

The construction of a conventional wire-wound inductor of this type is shown in FIG. 7 through FIG. 9. A wire-wound inductor 1 includes a square-flanged core member 2 constructed of a drum-like magnetic material, and a cylindrical case core member 3 as shown in an elevational sectional view in FIG. 7 and an exploded perspective view in FIG. 8. The square-flanged core member 2 includes a cylindrical wire-wound portion 6 around which a coil 4 is wound.

The cylindrical wire-wound portion 6 is provided with an upper square flange 7 and a lower square flange 8 on its top and bottom ends, respectively. The coil 4 is wound between the flanges 7 and 8. The cylindrical wire-wound portion 6 of the square-flanged core member 2 around which the coil 4 is wound is disposed inside of the case core member 3. A square opening 9 on the top side of the case core member 3 receives the upper flange 7 of the square-flanged core member 2, and an adhesive is applied to adhere the case core member 3 and the upper flange 7. The lower surface of the case core member 3 is in contact with the top surface of the lower flange 8 of the square-flanged core member 2 so that the case core member 3 is mounted on the lower flange 8. The core members 2 and 3 constitute a magnetic path of a magnetic flux generated by the coil 4. Terminal electrodes (not shown) are formed on the lower flange 8, and the ends of the coil 4 are connected to the terminal electrodes via soldering or a thermal compression bonding technique.

In the wire-wound inductor 1, the upper flange 7 of the square-flanged core member 2 is typically slightly smaller in dimension than the opening 9 of the case core member 3 so that the upper flange 7 is smoothly inserted into the opening 9. Thus, a gap g (see FIG. 7 and FIG. 9) is created between the square opening 9 and the upper flange 7. In the conventional wire-wound inductor 1, variations occur in the contact state between the upper flange 7 and the case core member 3. Specifically, when the center of the upper flange 7 is aligned with the center of the square opening 9 as shown in FIG. 10A, the upper flange 7 does not contact the case core member 3. When the center of the upper flange 7 is offset from the center of the square opening 9 as shown in FIG. 10B and FIG. 10C, the outer surface of the upper flange 7 touches one or two inner surfaces of the case core member 3 in a surface contact manner such that entire side surfaces of the upper flange 7 contact entire inner side surfaces of the case core member 3. When the upper flange 7 is disposed in a rotated state with respect to the square opening 9 as shown in FIG. 10D, the upper flange 7 touches the inner surface of the case core member 3 in a point contact manner only such that corner points of the upper flange 7 only contact the inner side surfaces of the case core member 3.

When the contact state between the upper flange 7 and the case core member 3 is varied in this way, a variation of a magnetic reluctance in a magnetic circuit defined by the square-flanged core member 2 and the case core member 3 occurs. The magnetic reluctance is considerably different when the case when outer surface of the upper flange 7 touches the case core member 3 as shown in FIG. 10B or FIG. 10C is compared with the case when the upper flange 7 is out of contact with the case core member 3. The conventional wire-wound inductor 1 thus suffers from a large variation in inductance.

SUMMARY OF THE INVENTION

To overcome the problems described above, preferred embodiments of the present invention provide a high-quality wire-wound inductor with minimal and negligible variations in inductance.

According to one preferred embodiment of the present invention, a wire-wound inductor preferably includes a substantially square-flanged core member having a wire-wound portion, around which a coil is wound, a substantially square flange provided at an end of the wire-wound portion, and a substantially cylindrical case core member accommodating the coil. The case core member is provided with a substantially square opening which receives the flange of the substantially square flange core member, and a corner abutment surface which the corner of the flange abuts and which is provided at a corner of an inner surface of the opening. The corner abutment surface may be a substantially planar surface or a substantially curved surface.

Since the opening of the case core member includes the corner abutment surfaces at the corners of its inner surface, the corners of the substantially square flange of the substantially square-flanged core member abut the respective corner abutment surfaces. The corner abutment surfaces prevent the flange of the substantially square-flanged core member from touching the case core member in a surface contact manner. Whether the flange of the substantially square-flanged core member is located at any position within the opening of the case core member, the flange of the substantially square-flanged core member remains out of contact with the case core member, or if in contact with the case core member at all, the flange of the square-flanged core member touches the case core member at a ridge defined by the apexes of the flange in a point contact manner only. This arrangement minimizes a variation in the magnetic reluctance of the magnetic circuit defined by the substantially square-flanged core member and the case core member.

Other features, elements, aspects and advantages of the present invention will become apparent from the following detailed description of preferred embodiments of the invention which refers to the accompanying drawings.

BRIEF DESCRIPTION OF THE DRAWINGS

FIGS. 2A and 2B are explanatory views showing variations in the positional relationship between a flange of a substantially square-flanged core member and an opening of a case core member in the wire-wound inductor shown in FIG. 1, wherein FIG. 2A shows that the center of the flange is offset from the center of the opening, and FIG. 2B shows that the flange is rotated with respect to the opening;

FIGS. 4A and 4B are explanatory views showing variations in the positional relationship between a flange of a substantially square-flanged core member and an opening of a case core member in the wire-wound inductor shown in FIG. 3, wherein FIG. 4A shows that the center of the flange is offset from the center of the opening, and FIG. 4B shows that the flange is rotated with respect to the opening;

FIGS. 10A–10D are explanatory views showing variations in the positional relationship between a flange of a square-flanged core member and an opening of a case core member in the wire-wound inductor shown in FIG. 7, wherein FIG. 10A shows that the center of the flange is generally aligned with the center of the opening, FIG. 10B and FIG. 10C show that the center of the flange is offset from the center of the opening, and FIG. 10D shows that the flange is in a rotated state with respect to the opening.

DETAILED DESCRIPTION OF PREFERRED EMBODIMENTS

Referring to the attached drawings, preferred embodiments of a wire-wound inductor of the present invention will be explained.

Figure 1:
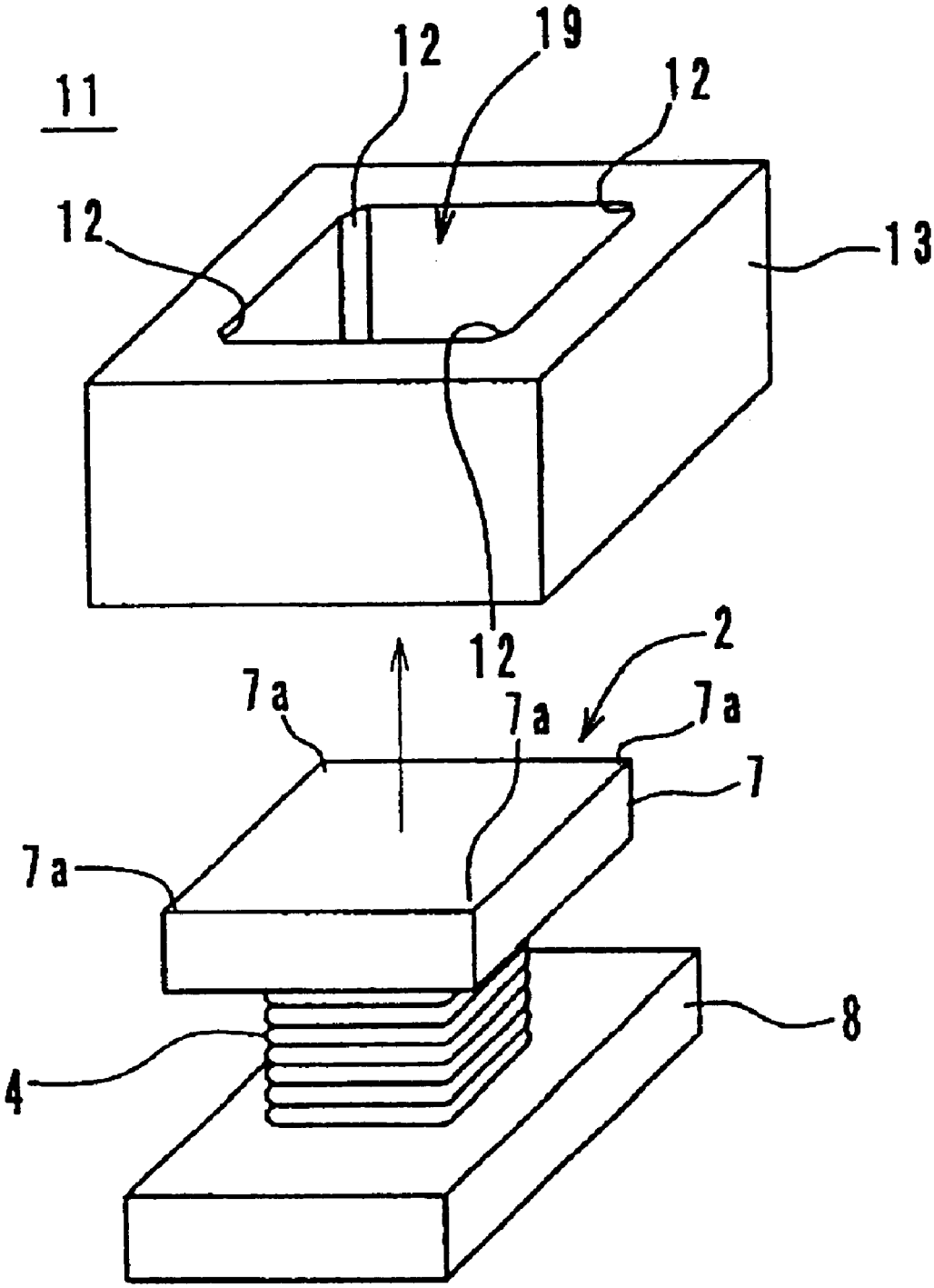
FIG. 1 is an exploded perspective view of a first preferred embodiment of the wire-wound inductor of the present invention.
Figure 7:
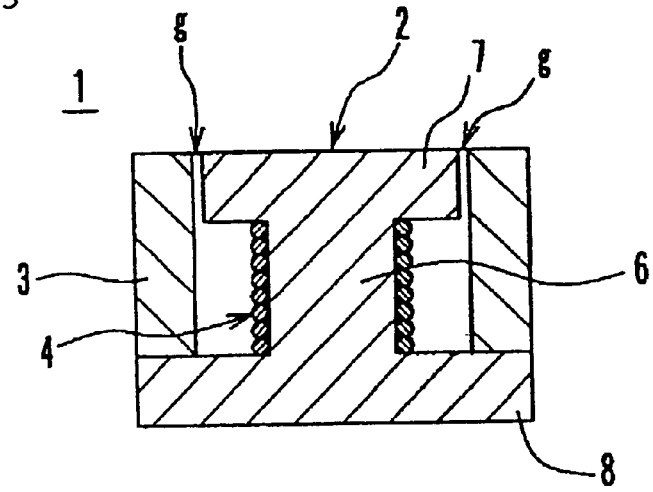
FIG. 7 is an elevational sectional view showing a conventional wire-wound inductor.
Figure 8:
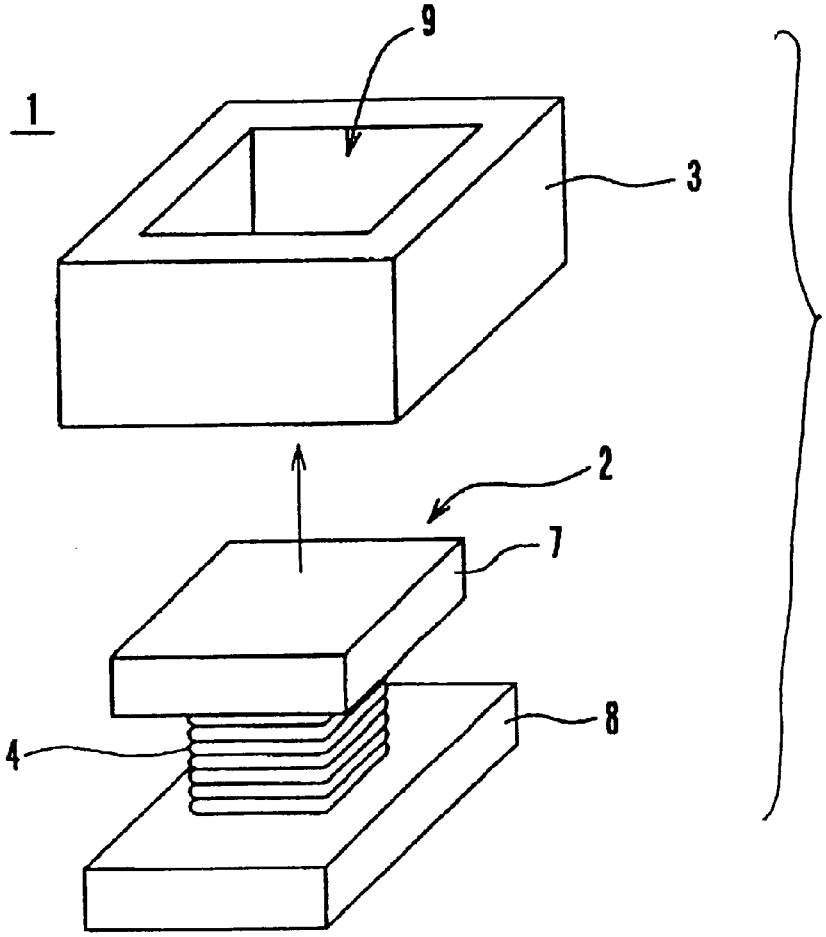
FIG. 8 is an exploded perspective view of the wire-wound inductor of FIG. 7.
Figure 9:
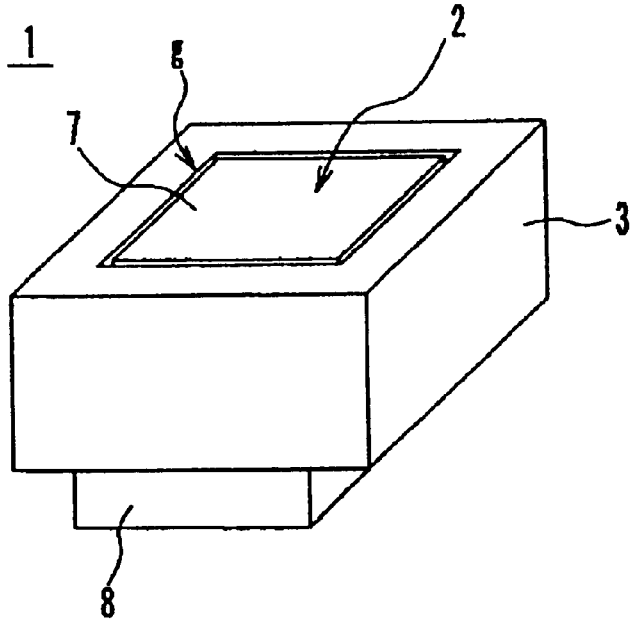
FIG. 9 is an external perspective view of the wire-wound inductor of FIG. 7.
Figure 10A:
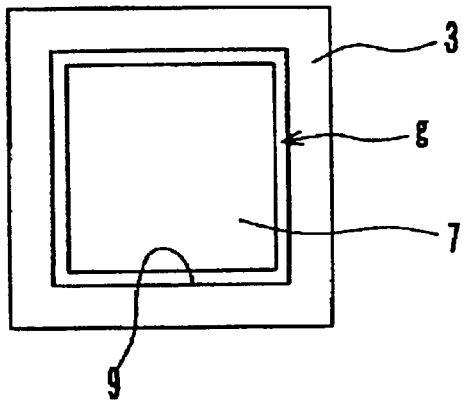
Figure 10B:
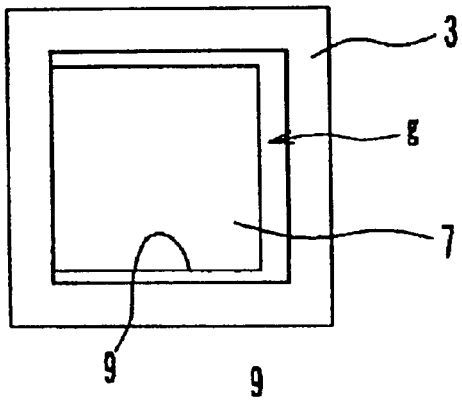
Figure 10C:
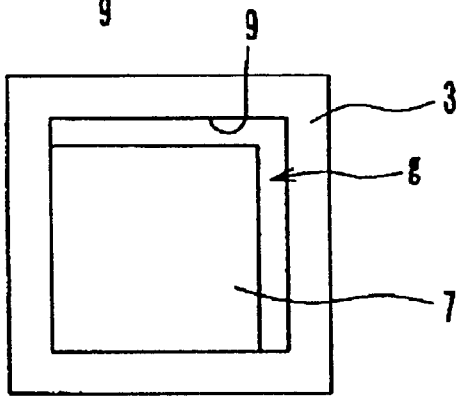
Figure 10D:
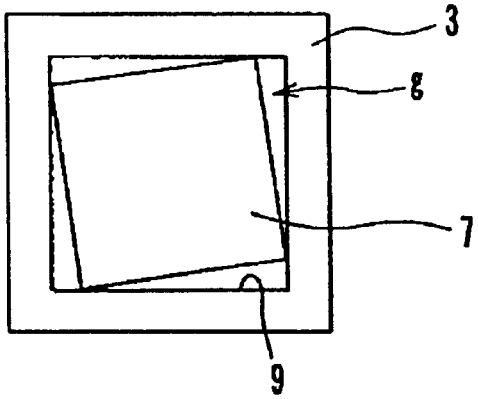

FIG. 1 is an exploded perspective view of a first preferred embodiment of the wire-wound inductor of the present invention. A wire-wound inductor 11 preferably includes a case core member 13 instead of the case core member 3 of the wire-wound inductor 1 described with reference to FIG. 7 through FIG. 9. The case core member 13 preferably includes four corner abutment surfaces 12 on the four corners of the inner surface of a substantially square opening 19 into which a substantially square upper flange 7 of a substantially square-flanged core member 2 is accommodated. A corner 7*a* of the upper flange 7 abuts the corner abutment surface 12. The corner abutment surface 12 is a planar surface. In FIG. 1, elements which are identical to those shown in FIG. 7 through FIG. 9 are indicated with the same reference numerals, and the explanation thereof is not repeated.

Figure 2A:
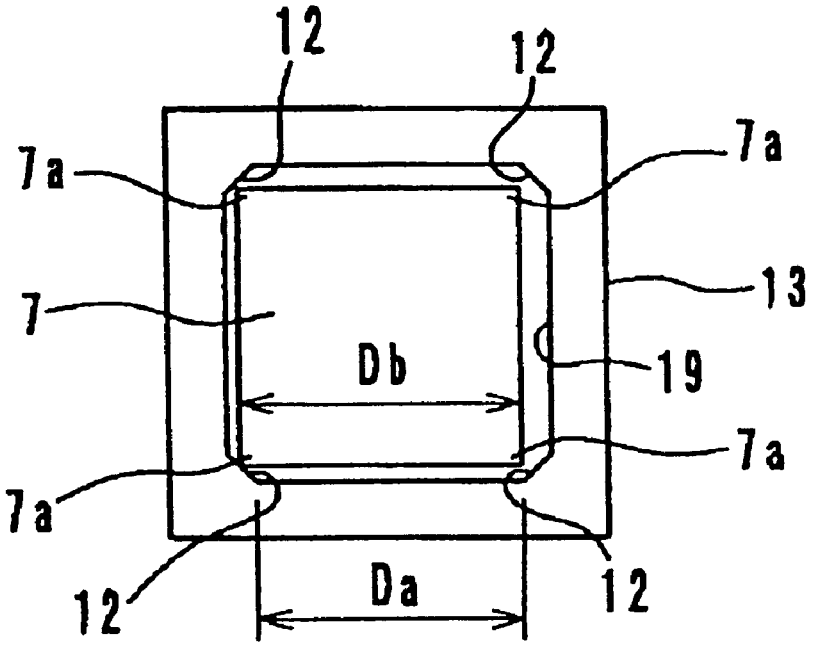

The corner abutment surface 12 is arranged such that a relationship Da<Db is satisfied, as shown in FIG. 2A, where Da represents the width of each side of the opening 19 excluding the corner abutment surfaces 12, and Db represents the width of each side of the upper flange 7 of the square-flanged core member 2. The mold for manufacturing the case core member 13 is beveled at its corners corresponding to the corner abutment surfaces 12. For example, ferrite powder, as a material of the case core member 13, is molded into a ferrite molded body using the mold, and is then baked at a temperature within a range of about 900° C. to about 1300° C. The case core members 13 are thus manufactured in a continuous fashion.

Figure 2B:
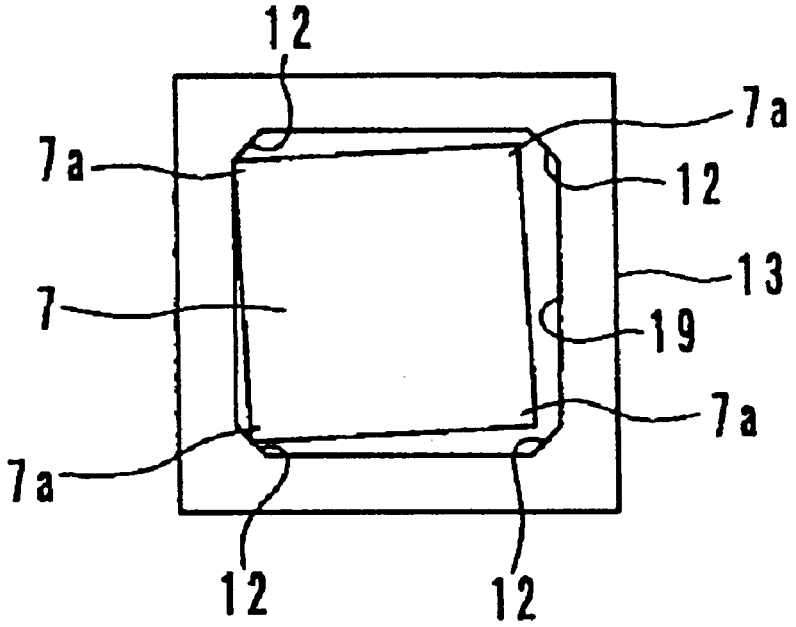

The corner abutment surfaces 12 are preferably located at the corners of the opening 19 of the case core member 13, and the length Da of the side of the opening 19 excluding the corner abutment surfaces 12 is shorter than the length Db of the side of the upper flange 7. For this reason, the two ridges defined by apexes 7*a* of the upper flange 7 contact the corner abutment surfaces 12 in a point contact manner when the center of the upper flange 7 is offset from the center of the opening 19, as shown in FIG. 2A. When the upper flange 7 is in a rotated state with respect to the opening 19, as shown in FIG. 2B, each of the two ridges defined by the apexes 7*a* of the upper flange 7 contacts the side of the opening 19 excluding the corner abutment surface 12 and the corner abutment surface 12 of the opening 19, respectively.

Whether the upper flange 7 of the square-flanged core member 2 is located at any position within the opening 19 of the case core member 13, the upper flange 7 of the square-flanged core member 2 remains out of contact with the case core member 13, or if in contact with the case core member 13 at all, the upper flange 7 of the square-flanged core member 2 touches the case core member 13 at its ridge defined by the apexes of the flange 7 in a point contact manner only. The arrangement prevents the outer surface of the upper flange 7 of the substantially square-flanged core member 2 from contacting the case core member 13 in a surface contact manner, and greatly reduces a variation in the magnetic reluctance of the magnetic circuit defined by the substantially square-flanged core member 2 and the case core member 13. Therefore, a wire-wound inductor 11 having a minimal inductance variation is achieved.

Figure 3:
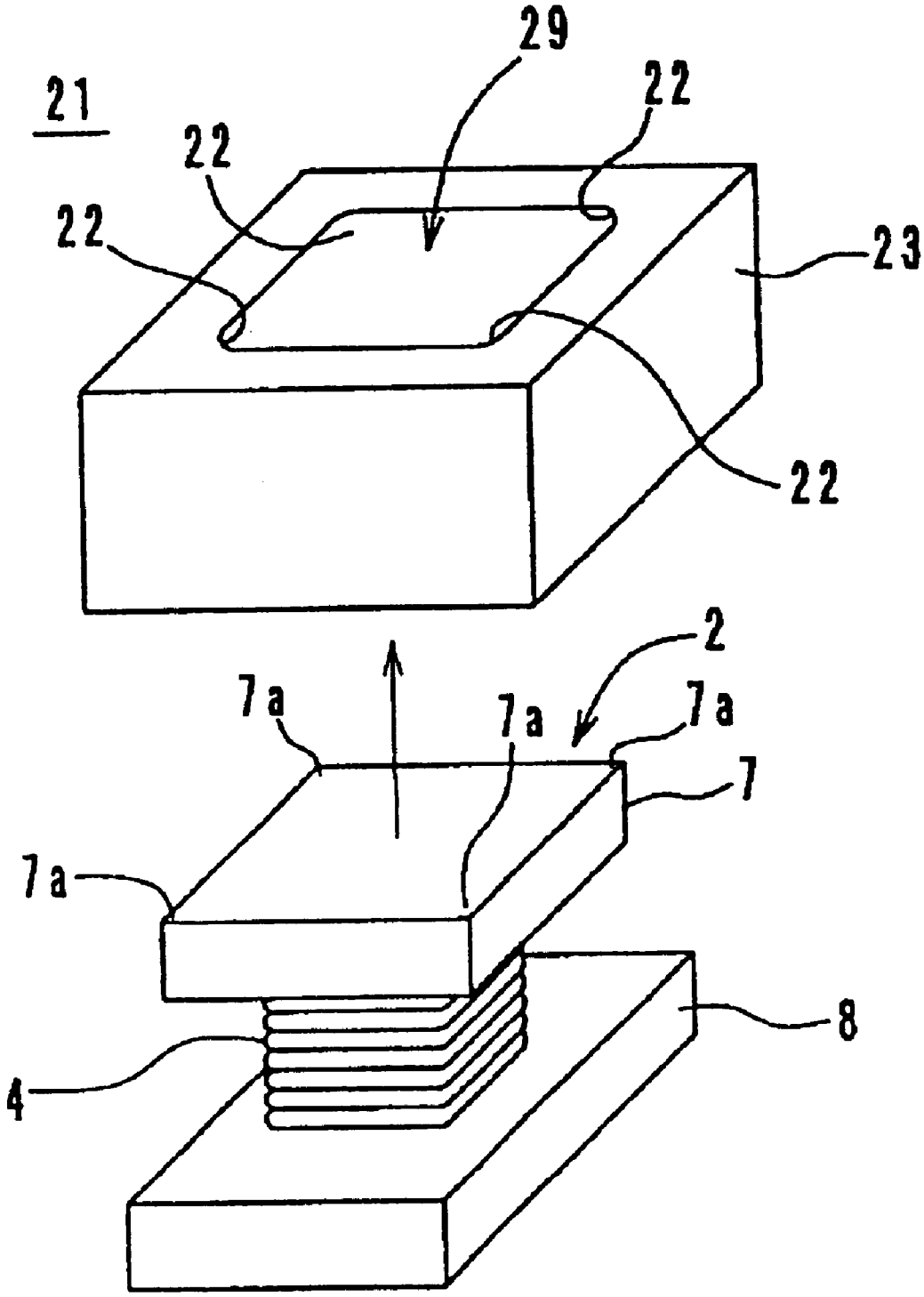
FIG. 3 is an exploded perspective view of a second preferred embodiment of the wire-wound inductor of the present invention.

FIG. 3 shows a second preferred embodiment of the wire-wound inductor of the present invention. A wire-wound inductor 21 preferably includes, as in the wire-wound inductor 11 described with reference to FIG. 1 through FIG. 2B, a corner abutment surface 22 defined at each corner of an opening 29 of a case core member 23 in which an upper flange 7 of a square-flanged core member 2 is inserted. The corner abutment surface 22 has a substantially circular, concave curved surface in cross section.

Figure 4A:
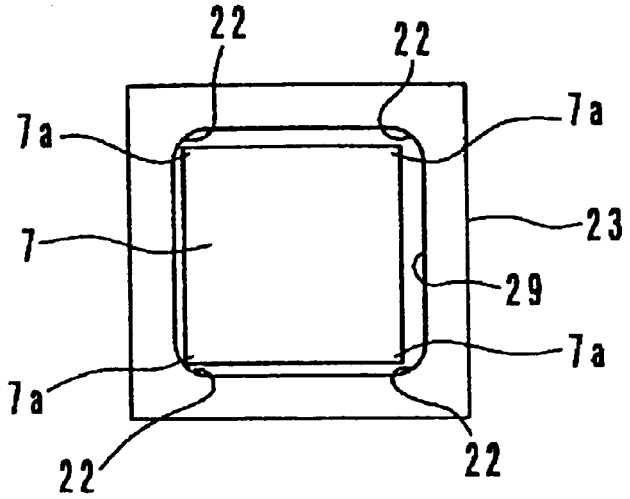
Figure 4B:
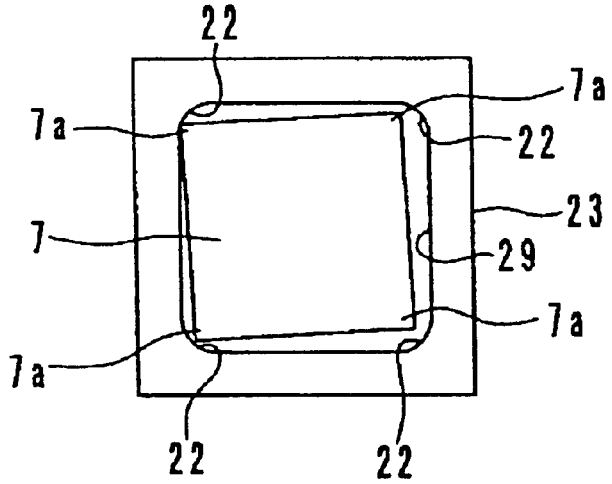

As seen from FIG. 4A and FIG. 4B, the upper flange 7 of the substantially square-flanged core member 2 is out of contact with the case core member 23, or if in contact with the case core member 23, the upper flange 7 of the square-flanged core member 2 contacts, in a point contact manner only, the opening 29 of the case core member 23 at the ridge defined by the apexes 7*a* of the upper flange 7. In this way, the upper flange 7 of the square-flanged core member 2 does not come into contact with the case core member 23 in a surface contact manner. This arrangement reduces a variation in the magnetic reluctance of the magnetic path defined by the substantially square-flanged core member 2 and the case core member 23. Thus, a wire-wound inductor 21 having minimal inductance variation is achieved. In FIGS. 3, 4A, and 4B, elements which are identical to those described with reference to FIGS. 1, 2A, and 2B are indicated with the same reference numerals, and the discussion about these elements is not repeated here.

Figure 5:
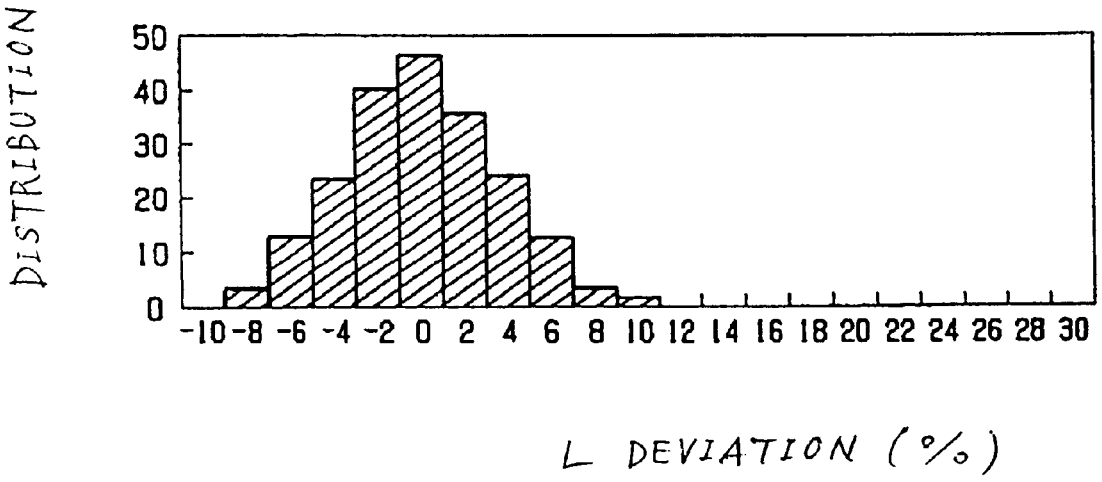
FIG. 5 shows the distribution of inductance, indicating measured inductance variations of the wire-wound inductor of FIG. 1.

Examples of the wire-wound inductors 11 in accordance with the first preferred embodiment were produced. The upper flange 7 of the substantially square-flanged core member 2, each side having a length of about 2.5 mm, was subjected to barrel polishing to slightly bevel its corners, and a corner abutment surface 12 having a width of about 0.25 mm was formed at each corner of the opening 19 of the case core member 13, each side having a length of about 2.75 mm. Samples of such wire-wound inductors 11 were prepared and the inductances of the samples were measured. FIG. 5 shows the distribution of inductances (L distribution) as measured.

Figure 6:
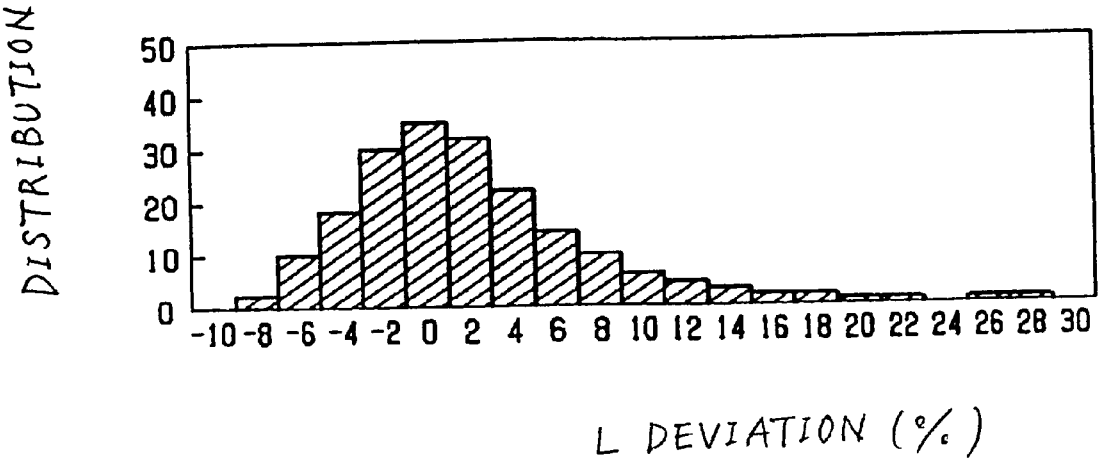
FIG. 6 shows the distribution of inductance, indicating measured inductance variations of a conventional wire-wound inductor.

Samples of the conventional wire-wound inductor 1 were produced. The upper flange 7 of the substantially square-flanged core member 2, each side having a length of about 2.5 mm, was slightly beveled, and the substantially square opening 9 of the wire-wound inductor 1, each side having a length of about 2.75 mm, was produced as shown in the conventional structure described with reference to FIG. 7 through FIG. 9. The inductance of each sample was measured. FIG. 6 shows the distribution of inductances (L distribution) as measured.

As is clear from FIG. 5 and FIG. 6, according to preferred embodiments of the present invention, the deviation of the inductance of the wire-wound inductor 11 having the case core member 13 with the corner abutment face 12 falls within a range of about ±10%. The wire-wound inductor 11 provides great improvements in minimizing variation in inductance over the conventional wire-wound inductor 1.

The present invention has been described in conjunction with the preferred embodiments. The present invention is not limited to preferred embodiments described herein, and changes are possible within the scope of the present invention. For example, the upper flange 7 of the substantially square-flanged core member 2 may have a substantially triangular shape, or a substantially polygonal shape, such as a pentagon.

In accordance with preferred embodiments of the present invention, because of the corner abutment surface provided in each corner of the opening of the case core member, the upper flange of the square-flanged core member remains out of contact with the case core member, or if in contact with the case core member, touches, in a line contact manner only, the opening of the case core member at the ridge defined by apexes of the upper flange of the substantially square-flanged core member. The upper flange of the substantially square-flanged core member is prevented from touching the case core member in a surface contact manner. This arrangement minimizes a variation in the magnetic reluctance of the magnetic path defined by the substantially square-flanged core member and the case core member. Thus, a wire-wound inductor having a minimal inductance variation is achieved.

While the invention has been particularly shown and described with reference to preferred embodiments thereof, it will be understood by those skilled in the art that the forgoing and other changes in form and details may be made therein without departing from the spirit of the invention.

What is claimed is:

1. A wire-wound inductor comprising:

a substantially square-flanged core member having a wire wound portion and coil wound around the wire wound portion, and a substantially square flange provided at an end of said wire wound portion; and a substantially cylindrical case core member accommodating said coil;

wherein said case core member is provided with a substantially square opening in which said flange of said substantially square-flanged core member is disposed; and at least one corner abutment surface is provided at a corner of an inner surface of said substantially square opening, which a corner of said flange abuts in a point contact manner.

2. A wire-wound inductor according to claim 1, wherein each of four corners of the inner surface of said opening includes a corner abutment surface.

3. A wire-wound inductor according to claim 2, wherein to ridges defined by apexes of the upper flange contact the at least one corner abutment surface in the point contact manner when the center of the upper flange is offset from the center of the substantially square opening.

4. A wire-wound inductor according to claim 1, wherein said corner abutment surface is a curved surface.

5. A wire-wound inductor according to claim 1, wherein the at least one corner abutment surface is arranged such that a relationship Da<Db is satisfied, where Da represents the width of each side of the substantially square opening excluding the at least one corner abutment surface, and Db represents the width of each side of the upper flange of the substantially square-flanged core member.

6. A wire-wound inductor according to claim 1, wherein each of four corners of the inner surface of said opening includes a corner abutment surface and the four corner abutment surfaces are arranged such that a relationship Da<Db is satisfied, where Da represents the width of each side of the substantially square opening excluding the corner abutment surfaces, and Db represents the width of each side of the upper flange of the substantially square-flanged core member.

7. A wire-wound inductor according to claim 1, wherein the case core member is made of a ferrite powder.

8. A wire-wound inductor according to claim 1, wherein to ridges defined by apexes of the upper flange contact the at least one corner abutment surface in the point contact manner when the center of the upper flange is offset from the center of the substantially square opening.

9. A wire-wound inductor according to claim 1, wherein said corner abutment surface is a planar surface.

10. A wire-wound inductor according to claim 1, wherein the at least one corner abutment surface has a substantially circular, concave curved surface in cross section.

11. A wire-wound inductor comprising:

a core member having a wire wound portion and coil wound around the wire wound portion, and a flange provided at an end of said wire wound portion; and a case core member accommodating said coil;

wherein said case core member is provided with an opening in which said flange of said core member is disposed; and at least one corner abutment surface is provided at a corner of an inner surface of said opening, which a corner of said flange abuts in a point contact manner.

12. A wire-wound inductor according to claim 11, wherein each of four corners of the inner surface of said opening includes a corner abutment surface.

13. A wire-wound inductor according to claim 12, wherein to ridges defined by apexes of the upper flange contact the at least one corner abutment surface in the point contact manner when the center of the upper flange is offset from the center of the opening.

14. A wire-wound inductor according to claim 11, wherein said corner abutment surface is a curved surface.

15. A wire-wound inductor according to claim 11, wherein the at least one corner abutment surface is arranged such that a relationship Da<Db is satisfied, where Da represents the width of each side of the opening excluding the at least one corner abutment surface, and Db represents the width of each side of the upper flange of the core member.

16. A wire-wound inductor according to claim 11, wherein each of four corners of the inner surface of said opening includes a corner abutment surface and the four corner abutment surfaces are arranged such that a relationship Da<Db is satisfied, where Da represents the width of each side of the opening excluding the corner abutment surfaces, and Db represents the width of each side of the upper flange of the core member.

17. A wire-wound inductor according to claim 11, wherein the case core member is made of a ferrite powder.

18. A wire-wound inductor according to claim 11, wherein two ridges defined by apexes of the upper flange contact the at least one corner abutment surface in a point contact manner when the center of the upper flange is offset from the center of the opening.

19. A wire-wound inductor according to claim 11, wherein said corner abutment surface is a planar surface.

20. A wire-wound inductor according to claim 11, wherein the at least one corner abutment surface has a substantially circular, concave curved surface in cross section.

* * * * *